US005189008A

United States Patent [19]

Murata et al.

[11] Patent Number: 5,189,008

[45] Date of Patent: Feb. 23, 1993

[54] THERMAL TRANSFER RECORDING SHEET AND INK COMPOSITION FOR PRODUCING THE SAME

[75] Inventors: Yukichi Murata, Kanagawa; Mio Nakamura, Tokyo, both of Japan; Takashi Morishima, Austin, Tex.

[73] Assignee: Mitsubishi Kasei Corporation, Tokyo, Japan

[21] Appl. No.: 654,469

[22] Filed: Feb. 13, 1991

[30] Foreign Application Priority Data

Feb. 14, 1990 [JP] Japan ..... 2-33064

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914, 211, 335, 336; 503/227

[56] References Cited

U.S. PATENT DOCUMENTS 4,808,568 2/1989 Gregory et al. ..... 503/227

FOREIGN PATENT DOCUMENTS 323259 5/1989 European Pat. Off. ..... 503/227

60-27594 2/1985 Japan ..... 503/227

OTHER PUBLICATIONS

Patent Abstracts of Japan, abstract of JP-A-60 27594.

Patent Abstracts of Japan, abstract of JP-A-63 39380.

*Primary Examiner*—B. Hamilton Hess

*Attorney, Agent, or Firm*—Sughrue, Mion, Zinn, Macpeak & Seas

[57] ABSTRACT

A thermal transfer recording sheet comprising a substrate having thereon a colorant layer, the colorant layer comprising a binder and a pyridone-type azo dyestuff represented by the following general formula (I):

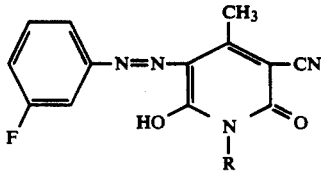

(I)

wherein R represents a hydrogen atom, an alkyl group having 2 or more carbon atoms, a substituted alkyl group, a cycloalkyl group, an allyl group, or a substituted or unsubstituted phenyl group is disclosed. A thermal transfer recording ink composition for use in forming the colorant layer on a substrate is also disclosed.

8 Claims, No Drawings

THERMAL TRANSFER RECORDING SHEET AND INK COMPOSITION FOR PRODUCING THE SAME

FIELD OF THE INVENTION

The present invention relates to a thermal transfer recording sheet for use in thermal transfer recording, particularly in sublimation-type thermal transfer recording, and to an ink composition for use in producing the thermal transfer recording sheet.

BACKGROUND OF THE INVENTION

Conventionally, studies are being made of color recording techniques based on electrophotographic printing, ink-jet printing, thermal transfer printing, etc., for the purpose of applying such color recording techniques to facsimile, copying machines, printers, or the like.

Among these recording techniques, the thermal transfer recording technique is thought to be more advantageous than the others because the maintenance and operation of the apparatus are easy and the apparatus and its expendable supplies are inexpensive.

There are two systems in the thermal transfer recording: fusion-type transfer in which a transfer recording sheet consisting of a base film and formed thereon a thermally fusible ink layer is heated with a thermal head to fuse the ink and transfer the fused ink to an image-receiving surface, thereby recording an image on the receiving surface; and sublimation-type transfer in which a transfer recording sheet consisting of a base film and formed thereon a colorant layer containing a sublimable dyestuff is heated with a thermal head to sublimate and/or heat-diffuse the dyestuff and transfer the dyestuff from the transfer recording sheet to an image-receiving surface, thereby recording an image on the receiving surface. The sublimation-type transfer is particularly advantageous to full-color recording over the fusion-type in that gradation recording is easy since the transferred amount of the dyestuff can be controlled by changing the energy fed to the thermal head.

In the thermal transfer recording of the sublimation type, sublimable dyestuffs used in transfer recording sheets and in ink compositions for producing transfer recording sheets greatly affect the speed of transfer recording, the quality and storage stability of prints, etc. Therefore, the sublimable dyestuffs are highly important and need to satisfy the following requirements:

(1) the dyestuffs should readily sublimate and/or heat-diffuse under operation conditions for the thermal head;

(2) they should not undergo thermal decomposition under operation conditions for the thermal head;

(3) they should possess tints favorable for color reproduction;

(4) they should have high molecular absorption coefficients;

(5) they should be stable to heat, light, moisture, chemicals, etc.;

(6) they should be able to be easily synthesized;

(7) they should have good suitability for use in preparing inks; and (8) they should have no health and safety problems.

However, a dyestuff which meets all the above requirements has not been found so far. Yellow dyestuffs, in particular, have various defects and satisfactory one has not yet been developed.

Conventionally known yellow dyestuffs having suitability to thermal transfer recording of the sublimation type are disclosed, for example, in JP-A-61-244595, JP-A-60-27594, and U.S. Pat. No. 4,808,568. (The term "JP-A" as used herein means an "unexamined published Japanese patent application".) These yellow dyestuffs are pyridone-type monoazo dyestuffs having the same basic structure as that of the dyestuff employed in the present invention. However, even the dyestuffs whose structural formulae are specified in those references have had still insufficient performances.

SUMMARY OF THE INVENTION

Under the above-stated circumstances, the present inventors have investigated pyridone-type azo dyestuffs in greater detail. As a result, it has been found that by introducing a fluorine atom into a pyridone-type azo compound at the meta position of the benzene ring bonded to the azo group, the resulting compound produces higher performance, particularly in sensitivity and light resistance, than the conventional pyridone-type azo dyestuffs. The present invention has been completed based on this finding.

Accordingly, an object of the present invention is to provide a thermal transfer recording sheet employing a yellow dyestuff which satisfies all of the above-listed requirements.

Another object of the present invention is to provide an ink composition for use in manufacturing the thermal transfer recording sheet.

Other objects and effects of the present invention will be apparent from the following description.

In one aspect of the present invention, a thermal transfer recording sheet is provided which comprises a substrate having thereon a colorant layer, the colorant layer comprising a binder and a pyridone-type azo dyestuff represented by the following general formula (I):

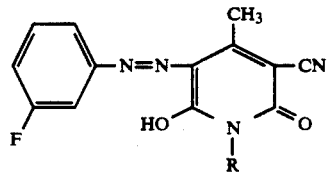

(I)

wherein R represents a hydrogen atom, an alkyl group having 2 or more carbon atoms, a substituted alkyl group, a cycloalkyl group, an allyl group, or a substituted or unsubstituted phenyl group.

In another aspect of the present invention, an ink composition for use in manufacturing the above thermal transfer recording sheet is provided which ink composition comprises the pyridone-type azo dyestuff represented by general formula (I), a binder resin, and a medium.

DETAILED DESCRIPTION OF THE INVENTION

The dyestuff employed in the present invention and represented by general formula (I) given above is explained below referring to its examples. Examples of the unsubstituted alkyl group represented by R in general formula (I) include straight-chain or branched alkyl groups having 2 to 8 carbon atoms. Examples of the substituted alkyl group represented by R include groups formed by substituting straight-chain or branched alkyl groups having 1 to 8 carbon atoms. Specific examples thereof include hydroxy-substituted alkyl groups such as 2-hydroxyethyl group, 3-hydroxypropyl group, 4-hydroxybutyl group, and 2-hydroxypropyl group; carboxy-substituted alkyl groups such as carboxymethyl group, 2-carboxyethyl group, and 3-carboxypropyl group; cyano-substituted alkyl groups such as 2-cyanoethyl group and cyanomethyl group; amino-substituted alkyl groups such as 2-aminoethyl group; halogen-substituted alkyl groups such as 2-chloroethyl group, 3-chloropropyl group, 2-chloropropyl group, and 2,2,2-trifluoroethyl group; alkyl groups substituted with phenyl group which may have a halogen atom, such as benzyl group, p-chlorobenzyl group, and 2-phenylethyl group; alkoxy-substituted alkyl groups such as 2-methoxyethyl group, 2-ethoxyethyl group, 2-n-propoxyethyl group, 2-isopropoxyethyl group, 2-n-butoxyethyl group, 2-isobutoxyethyl group, 2-(2-ethylhexyloxy)ethyl group, 3-methoxypropyl group, 4-methoxybutyl group, and 2-methoxypropyl group; alkoxyalkoxy-substituted alkyl groups such as 2-(2-methoxyethoxy)ethyl group, 2-(2-ethoxyethoxy)ethyl group, 2-(2-n-propoxyethoxy)ethyl group, 2-(2-isopropoxyethoxy)ethyl group, 2-(2-n-butoxyethoxy)ethyl group, 2-(2-isobutoxyethoxy)ethyl group, and 2-(2-(2-ethylhexyloxy)ethoxy)ethyl group; alkenyloxyalkyl groups such as allyloxyethyl group; aryloxyalkyl groups such as 2-phenoxyethyl group; aralkyloxysubstituted alkyl groups such as 2-benzyloxyethyl group alkyl groups substituted with an acyloxy group which may be substituted with a halogen atom, such as 2-acetyloxyethyl group, 2-propionyloxyethyl group, 2-n-butyryloxyethyl group, 2-isobutyryloxyethyl group, and 2-trifluoroacetyloxyethyl group; alkyl groups substituted with a substituted or unsubstituted alkoxycarbonyl group, such as methoxycarbonylmethyl group, ethoxycarbonylmethyl group, n-propoxycarbonylmethyl group, isopropoxycarbonylmethyl group, n-butoxycarbonylmethyl group, isobutoxycarbonylmethyl group, 2-ethylhexyloxycarbonylmethyl group, benzyloxycarbonylmethyl group, furfuryloxycarbonylmethyl group, tetrahydrofurfuryloxycarbonylmethyl group, 2-methoxycarbonylethyl group, 2-ethoxycarbonylethyl group, 2-n-propoxycarbonylethyl group, 2-isopropoxycarbonylethyl group, 2-n-butoxycarbonylethyl group, 2-isobutoxycarbonylethyl group, 2-(2-ethylhexyloxycarbonyl)ethyl group, 2-benzyloxycarbonylethyl group, and 2-furfurylcarbonylethyl group; alkyl groups substituted with a substituted or unsubstituted alkoxycarbonyloxy group, such as 2-methoxycarbonyloxyethyl group, 2-ethoxycarbonyloxyethyl group, 2-n-propoxycarbonyloxyethyl group, 2-isopropoxycarbonyloxyethyl group, 2-n-butoxycarbonyloxyethyl group, 2-isobutoxycarbonyloxyethyl group, 2-(2-ethylhexyloxycarbonyloxy)ethyl group, 2-benzyloxycarbonyloxyethyl group, and 2-furfuryloxycarbonyloxyethyl group; heterocyclic ring-substituted alkyl groups such as furfuryl group and tetrahydrofurfuryl group; and the like.

Examples of the cycloalkyl group represented by R include cyclopentyl group, cyclohexyl group, and the like.

Examples of the substituted phenyl group represented by R include phenyl group substituted with a straight-chain or branched alkyl group having 1 to 8 carbon atoms; phenyl group substituted with a straight-chain or branched alkoxyl group having 1 to 4 carbon atoms; phenyl group substituted with a halogen atom such as fluorine atom, chlorine atom, or bromine atom; and phenyl group substituted with nitro group, cyano group, trifluoromethyl group, or the like.

Particularly preferred examples of the group of R include straight-chain or branched alkyl groups having 2 to 8 carbon atoms, alkoxyalkyl groups having 3 to 8 carbon atoms, benzyl group, 2-phenylethyl group, allyl group, dialkylaminoalkyl groups having 4 to 10 carbon atoms, and the like.

Specific examples of the dyestuff represented by general formula (I) described above are listed in the following Table 1.

TABLE 1

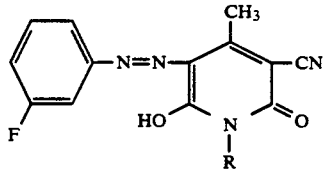

| No. | R | No. | R | No. | R |
|---|---|---|---|---|---|
| 1 | $-H$ | | | 2 | $-C_4H_9(n)$ |
| 3 | $-C_6H_{13}(n)$ | 4 | $-C_8H_{17}(n)$ | 5 | $-C_4H_9(i)$ |
| 6 | $-CH_2CH(CH_2)_3CH_3$ \| $CH_2CH_3$ | 7 | $-CH_2CH{=}CH_2$ | 8 | $-(CH_2)_2OH$ |
| 9 | $-(CH_2)_3OH$ | 10 | $-(CH_2)_4OH$ | 11 | $-CH_2CHCH_3$ \| $OH$ |
| 12 | $-CH_2COOH$ | 13 | $-(CH_2)_2COOH$ | 14 | $-(CH_2)_5COOH$ |
| 15 | $-(CH_2)_2CN$ | 16 | $-CH_2CN$ | 17 | $-(CH_2)_2NH_2$ |
| 18 | $-(CH_2)_2Cl$ | 19 | $-(CH_2)_3Cl$ | 20 | $-CH_2CHCH_3$ \| $Cl$ |

TABLE 1-continued

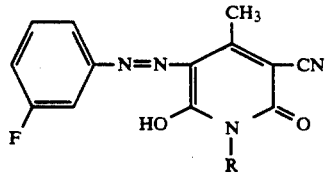

| No. | R | No. | R | No. | R |
|---|---|---|---|---|---|
| 21 | $-CH_2CF_3$ | 22 | $-CH_2-C_6H_5$ | 23 | $-CH_2-C_6H_4-Cl$ |
| 24 | $-(CH_2)_2-C_6H_5$ | 25 | $-(CH_2)_2OCH_3$ | 26 | $-(CH_2)_2OC_3H_7(n)$ |
| 27 | $-(CH_2)_2OC_4H_9(n)$ | 28 | $-(CH_2)_2OC_4H_9(i)$ | 29 | $-(CH_2)_2OCH_2CH(C_2H_5)C_4H_9(n)$ |
| 30 | $-(CH_2)_2OCH_3$ | 31 | $-(CH_2)_3OC_3H_7(i)$ | 32 | $-(CH_2)_3OC_4H_9(n)$ |
| 33 | $-(CH_2)_2OCH_3$ | 34 | $-CH_2CH(OCH_3)CH_3$ | 35 | $\{(CH_2)_2O\}_2CH_3$ |
| 36 | $\{(CH_2)_2O\}_2CH_2CH_3$ | 37 | $\{(CH_2)_2O\}_2C_3H_7(n)$ | 38 | $\{(CH_2)_2O\}_2C_3H_7(i)$ |
| 39 | $\{(CH_2)_2O\}_2C_4H_9(n)$ | 40 | $\{(CH_2)_2O\}_2C_4H_9(i)$ | 41 | $\{(CH_2)_2O\}_2CH_2CH(C_4H_9(n))C_2H_5$ |
| 42 | $-(CH_2)_2OCH_2CH=CH_2$ | 43 | $-(CH_2)_2O-C_6H_5$ | 44 | $-(CH_2)_2OCH_2-C_6H_5$ |
| 45 | $-(CH_2)_2O-CO-CH_3$ | 46 | $-(CH_2)_2O-CO-C_3H_7(n)$ | 47 | $-(CH_2)_2O-CO-C_4H_9(n)$ |
| 48 | $-(CH_2)_2O-CO-C_4H_9(i)$ | 49 | $-(CH_2)_2O-CO-CF_3$ | 50 | $-CH_2CO-OCH_3$ |
| 51 | $-CH_2CO-OCH_2CH_3$ | 52 | $-CH_2CO-OC_3H_7(n)$ | 53 | $-CH_2CO-OC_3H_7(i)$ |
| 54 | $-CH_2CO-OC_4H_9(n)$ | 55 | $-CH_2CO-OC_4H_9(i)$ | 56 | $-CH_2CO-OCH_2CH(C_4H_9(n))C_2H_5$ |
| 57 | $-CH_2CO-O-CH_2-C_6H_5$ | 58 | $-CH_2CO-OCH_2-$ 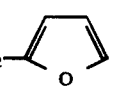 | 59 | $-CH_2CO-O-CH_2-$ 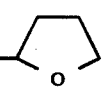 |
| 60 | $-(CH_2)_2CO-OCH_3$ | 61 | $-(CH_2)_2CO-OCH_2CH_3$ | 62 | $-(CH_2)_2CO-OC_3H_7(n)$ |
| 63 | $-(CH_2)_2CO-OC_3H_7(i)$ | 64 | $-(CH_2)_2CO-OC_4H_9(n)$ | 65 | $-(CH_2)_2CO-OC_4H_9(i)$ |
| 66 | $-(CH_2)_2CO-OCH_2CH(C_4H_9(n))C_2H_5$ | 67 | $-(CH_2)_2CO-OCH_2-C_6H_5$ | 68 | $-(CH_2)_2CO-OCH_2-$ 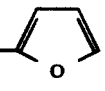 |
| 69 | $-(CH_2)_2O-CO-OCH_3$ | 70 | $-(CH_2)_2O-CO-OC_2H_5$ | 71 | $-(CH_2)_2O-CO-OC_3H_7(n)$ |
| 72 | $-(CH_2)_2O-CO-OC_3H_7(i)$ | 73 | $-(CH_2)_2O-CO-OC_4H_9(n)$ | 74 | $-(CH_2)_2O-CO-OC_4H_9(i)$ |
| 75 | $-(CH_2)_2O-CO-OCH_2CH(C_4H_9(n))C_2H_5$ | 76 | $-(CH_2)_2O-CO-OCH_2-C_6H_5$ | 77 | $-(CH_2)_2O-CO-OCH_2-$ 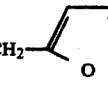 |

TABLE 1-continued

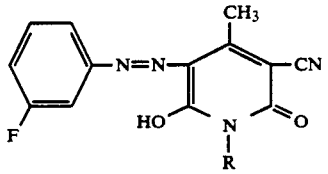

| No. | R | No. | R | No. | R |
|---|---|---|---|---|---|
| 78 | 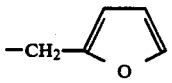 | 79 | 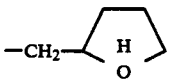 | 80 | 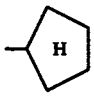 |
| 81 | 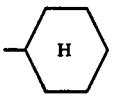 | 82 | 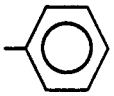 | 83 | 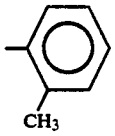 |
| 84 | 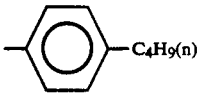 | 85 | 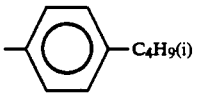 | 86 | 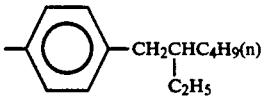 |
| 87 | 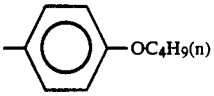 | 88 | 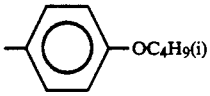 | 89 | 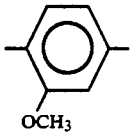 |
| 90 | 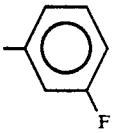 | 91 | 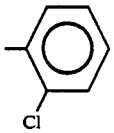 | 92 | 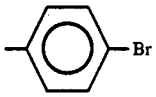 |
| 93 | 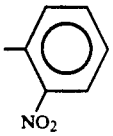 | 94 | 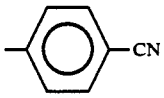 | 95 | 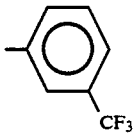 |
| 96 | 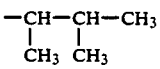 | 97 | 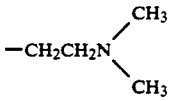 | 98 | 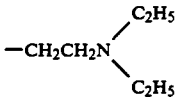 |
| 99 | 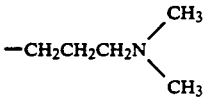 | 100 | 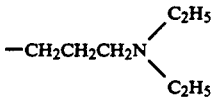 | 101 | 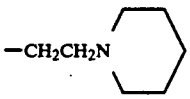 |
| 102 | 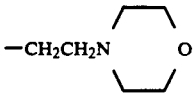 | 103 | 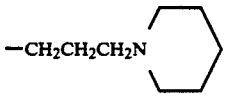 | 104 | 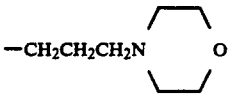 |
| 105 | 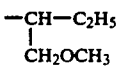 | 106 | 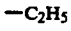 | | |

The pyridone-type azo dyestuff of general formula (I) to be employed in the present invention can be produced according to conventionally known methods. For example, it may be obtained by diazotizing m-fluoroaniline in an ordinary manner and then coupling the diazotization product with a pyridone derivative of the following general formula (II):

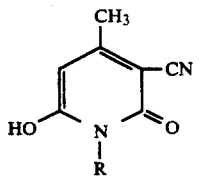

(II)

(wherein R has the same meaning as in general formula (I) given hereinabove) in an ordinary manner.

In manufacturing the thermal transfer recording sheet of the present invention, methods for forming the colorant layer containing the dyestuff of general formula (I) are not particularly limited. Generally, the dyestuff is dissolved or finely dispersed, along with a binder, in a medium to prepare an ink, which is then applied on a substrate and dried, thereby forming a colorant layer on the substrate.

The binder for use in ink preparation should have good heat resistance for the purpose of preventing the heat fusion-adhesion of the binder onto an image-receiving surface at the time of transfer recording. Especially preferred binders are ones having softening points and/or heat deformation temperatures of 100° C. or more.

Examples of the binder include water-soluble resins such as cellulose resins, acrylic acid-based resins, starches, polyvinyl alcohols, and polyethylene oxides, organic solvent-soluble resins such as acrylic resins, methacrylic resins, polystyrenes, polycarbonates, polysulfones, AS resins, polyethersulfones, epoxy resins, polyvinyl acetals, phenoxy resins, polyvinyl butyrals, polyesters, ethyl celluloses, and acetyl celluloses, and the like.

According to the medium to be used for ink preparation, a binder soluble or uniformly dispersible into the medium may be suitably selected from the above resins.

The amount of such a binder resin used is generally in the range of from 1 to 40% by weight, preferably from 5 to 30% by weight, based on the total amount of the ink composition.

Besides water, examples of the medium for use in the ink preparation are organic solvents which include alcohols such as methyl alcohol, n-propyl alcohol, isopropyl alcohol, n-butyl alcohol, and isobutyl alcohol, Cellosolves such as methyl Cellosolve, ethyl Cellosolve and butyl Cellosolve, aromatics such as toluene, xylene, and chlorobenzene, esters such as ethyl acetate and butyl acetate, ketones such as acetone, methyl ethyl ketone, methyl isobutyl ketone, and cyclohexanone, chlorine-containing solvents such as methylene chloride, chloroform, and trichloroethylene, ethers such as tetrahydrofuran and dioxane, N,N-dimethylformamide, N-methylpyrrolidone, and the like. These may be used alone or as a mixture of two or more thereof.

In addition to the ingredients described above, organic or inorganic non-sublimable fine particles, a dispersant, an antistatic agent, an anti-blocking agent, an anti-foaming agent, an antioxidant, a viscosity modifier, a release agent, and the like may be incorporated into the ink if required and necessary.

Preferred examples of the substrate on which the ink is to be applied for preparing the thermal transfer recording sheet include a sheet of paper such as capacitor paper, glassine paper, or the like, and a film of heat-resistant plastics such as polyesters, polycarbonates, polyamides, polyimides, polyaramids, or the like. The thickness of such a substrate may be in the range of from 1 to 50 μm.

Of the above substrates, a polyethylene terephthalate film is particularly advantageous because of its high mechanical strength, good solvent resistance, low cost, etc. In some cases, however, the polyethylene terephthalate film is not always satisfactory in heat resistance, resulting in insufficient running of the thermal head. Therefore, a heat-resistant resin layer containing a surface-active agent, lubricating heat-resistant particles, etc. may be provided on the side opposite to the colorant layer, thus providing improved thermal head-running properties.

Coating of the ink on the substrate can be accomplished by use of a reverse-roll coater, a gravure coater, a rod coater, an air-doctor coater, or the like. The coating may be performed so as to give an ink coating layer thickness in the range of from 0.1 to 5 μm on a dry basis. (Reference may be made to Yuji Harasaki, *Coating Techniques*, published in 1979 by Maki Shoten, Japan.)

On the other hand, the ink composition for use in producing the thermal transfer recording sheet, which ink composition is provided according to another aspect of the present invention, comprises a pyridone-type azo dyestuff represented by the above-described general formula (I), a binder resin, and a medium that may be an organic solvent and/or water.

The pyridone-type azo dyestuff is as described in detail hereinabove.

The binder to be used is suitably selected from the above-mentioned resins which are soluble in water or organic solvents, according to the medium to be used.

Of the above-mentioned resins, those having heat deformation temperatures and/or softening points of 100° C. or more are particularly preferred. As the organic solvent, any of the above-mentioned solvents may be used. In addition to these, non-sublimable fine particles and additives such as a dispersant, antistatic agent, anti-blocking agent, anti-foaming agent, antioxidant, viscosity modifier, and release agent may be used as mentioned hereinabove.

The amount of the dyestuff of general formula (I) contained in the ink composition of the present invention is generally from 1 to 30% by weight, preferably from 3 to 20% by weight, based on the total amount of the ink composition.

The ink composition of the present invention may be prepared as follows. In one method, a liquid mixture composed of the dyestuff, a medium,. and a resin is placed in a proper vessel equipped with a stirrer and the dyestuff is dissolved in the medium, with heating if required and with addition of additives etc. if necessary, thereby to prepare an ink composition. Alternatively, the liquid mixture may be treated with a paint conditioner, ball mill, sand grinding mill, or the like to uniformly disperse the dyestuff into the medium, with addition of additives etc. if necessary, thereby to prepare an ink composition.

Because the pyridone-type azo dyestuff of general formula (I) which is employed in the thermal transfer recording sheet of the present invention possesses a vivid yellow color, it is suited for use in combining it with suitable cyan color dyestuffs and suitable magenta color dyestuffs to attain full-color recording with good color reproduction. Further, because the dyestuff of general formula (I) readily sublimates and/or heat-diffuses and has a high molecular absorption coefficient, recorded images having high color densities can be obtained at a high speed without a heavy load on the thermal head. The dyestuff also has good stability to heat, light, moisture, chemicals, etc. and, hence, it never undergoes thermal decomposition during transfer recording and the permanence properties of the resulting recorded images are also good, particularly in light resistance. In addition, since the dyestuff of general formula (I) has good solubility in organic solvents and good dispersibility into water, it is easy to prepare an ink composition in which the dyestuff has been uniformly dissolved or dispersed at a high concentration, and by use of such an ink composition, a thermal transfer recording sheet having a colorant coating layer in which the dyestuff is distributed uniformly at a high concentration can be obtained. Therefore, by use of such a thermal transfer recording sheet, printed images having good homogeneity and color density can be obtained.

In practicing transfer recording using the thermal transfer recording sheet of the present invention, infrared rays, laser light, etc. as well as a thermal head may be utilized as a heating means.

It is also possible to coat the ink composition of the present invention on a film that is heated by application of electric current and to use the resulting sheet as an electrically-heated thermal transfer recording sheet.

The present invention will be explained below in more detail by reference to the following examples, which should not be construed to be limiting the scope of the invention. In these examples, all parts are by weight.

EXAMPLE 1

(a) Preparation of Ink

| | |
|---|---|
| Dyestuff No. 3 in Table 1 | 5 g |
| Polysulfone resin* | 10 g |
| Chlorobenzene | 100 g |
| Total | 115 g |

*trade name, "Udel P-1700"; manufactured by Nissan Chemical Industries, Ltd., Japan; heat-deformation temperature (ASTM D-648) 175° C.

A mixture having the above composition was treated with a paint conditioner for 10 minutes, thereby preparing an ink.

(b) Preparation of Transfer Recording Sheet

The above-obtained ink was coated with a wire bar on a polyethylene terephthalate film (6 μm thick) whose back side had undergone treatment for imparting heat resistance and lubricating properties. The coating was then dried (coating layer dry thickness, about 1 μm) to obtain a transfer recording sheet. The above treatment for imparting heat resistance and lubricating properties to the polyethylene terephthalate film was conducted by coating the film with a fluid consisting of 8 parts of a polycarbonate resin having the recurring unit of the formula

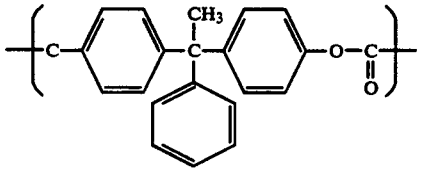

1 part of a phosphoric ester-type surfactant (trade name, "Plysurf A-208B"; manufactured by Dai-ichi Kogyo Seiyaku Co., Ltd., Japan), and 91 parts of toluene, and drying the coating (coating layer dry thickness, about 0.5 μm).

(c) Preparation of Image-Receiving Sheet

A composition consisting of 10 parts of a saturated polyester resin (trade name, "TP-220"; manufactured by Nihon Gosei Co., Ltd., Japan), 0.5 part of an amino-modified silicone (trade name, "KF 393"; manufactured by Shin-Etsu Chemical Co., Ltd., Japan), 15 parts of methyl ethyl ketone, and 15 parts of xylene was coated on a synthetic paper (trade name, "Yupo FPG 150"; manufactured by Oji-Yuka Co., Ltd., Japan) with a wire bar, and then dried (coating layer dry thickness, about 5 μm). The coated synthetic paper was further heat-treated in an oven at 100° C. for 30 minutes to prepare an image-receiving sheet.

(d) Transfer Recording

The transfer recording sheet prepared in (b) above was superimposed on the image-receiving sheet in such a manner that the ink coating side of the transfer recording sheet was in contact with the receiving sheet, and recording was conducted by use of a thermal head under the conditions shown below. As a result, a recorded image which was of a vivid yellow color and had a uniform color density as shown in Table 3 could be obtained.

| Recording Conditions | |
|---|---|
| Lineal density for main scanning and sub-scanning: | 8 dots/mm |
| Recording power: | 0.25 W/dot |
| Heating time for head: | 10 msec |

Color density was measured with densitometer TR-927 manufactured by Macbeth Corporation, U.S.A.

The light resistance of the recorded image obtained was examined by means of a carbon arc fadeometer (manufactured by Suga Testing Machine Co., Ltd., Japan) at a black panel temperature of 63°+2° C. The degree of discoloration through a 40-hour irradiation in the light resistance test was shown in Table 3 in terms of ΔE* value Further, the transfer recording sheet and the print obtained were found to be stable to heat and moisture and show good storage stability in the dark.

The dyestuff used in this example had been synthesized by diazotizing m-fluoroaniline in an ordinary way and coupling the diazotization product with N-(n-hexyl)-3-cyano-4-methyl-6-hydroxy-2-pyridone in water medium. Its maximum absorption wavelength in acetone was as shown in Table 3 and its melting point was 156.9°-158.8° C.

EXAMPLES 2 TO 11

Inks and transfer recording sheets were prepared and transfer recording was conducted in the same manner as in Example 1 except that in place of the dyestuff used in Example 1, the dyestuffs shown in Table 3 were used. As a result, recorded images which were of a vivid yellow color and respectively had color densities shown in Table 3 could be obtained, and the light resistance of each recorded image was good as shown in Table 3.

COMPARATIVE EXAMPLES 1 TO 13

Inks and transfer recording sheets were prepared and transfer recording and a light resistance test were conducted in the same manner as in Example 1 except that the dyestuffs shown in Table 2 given below were used in place of the dyestuff used in Example 1. The results obtained are summarized in Table 3.

TABLE 2

(Dyestuffs used in Comparative Examples)

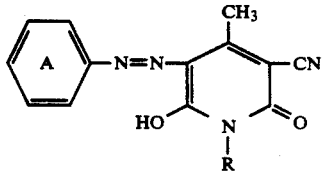

| Comparative Example No. | A | —R |
|---|---|---|
| 1* | 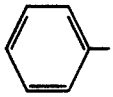 | $-C_4H_9(n)$ |
| 2 | " | $-C_4H_9(i)$ |
| 3 | " | $-C_8H_{17}(n)$ |
| 4* | " | $-C_2H_4OCH_3$ |
| 5 | " | $-CH_2CH{=}CH_2$ |
| 6* | 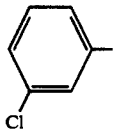 | $-CH_3$ |
| 7 | " | $-C_4H_9(i)$ |
| 8** | 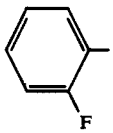 | $-C_4H_9(n)$ |
| 9 | " | $-C_4H_9(i)$ |
| 10** | 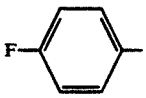 | $-C_4H_9(n)$ |
| 11 | " | $-C_4H_9(i)$ |
| 12 | 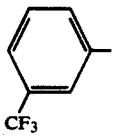 | $-C_4H_9(i)$ |

TABLE 2-continued (Dyestuffs used in Comparative Examples)

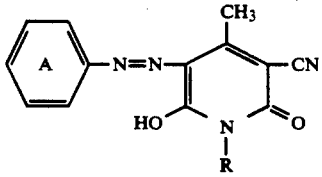

| Comparative Example No. | A | —R |
|---|---|---|
| 13 | 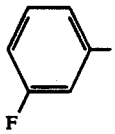 | $-CH_3$ |

Note:
*Dyestuffs described in JP-A-60-27594
**Dyestuffs described in JP-A-62-290583

TABLE 3

| | Dye No. | Maximum absorption wavelength* (nm) | Color density | Light resistance(ΔE*) |
|---|---|---|---|---|
| Example 1 | 3 | 426 | 2.02 | 3.21 |
| Example 2 | 2 | 426 | 2.05 | 3.15 |
| Example 3 | 6 | 427 | 1.95 | 3.86 |
| Example 4 | 31 | 426 | 1.96 | 3.92 |
| Example 5 | 32 | 426 | 1.99 | 3.95 |
| Example 6 | 4 | 426 | 2.01 | 3.90 |
| Example 7 | 7 | 426 | 2.12 | 4.10 |
| Example 8 | 22 | 426 | 1.90 | 3.81 |
| Example 9 | 24 | 426 | 1.95 | 3.51 |
| Example 10 | 79 | 426 | 1.98 | 3.85 |
| Example 11 | 106 | 426 | 1.72 | 2.30 |
| Comparative Example 1 | — | 431 | 1.75 | 8.12 |
| Comparative Example 2 | — | 432 | 1.55 | 2.16 |
| Comparative Example 3 | — | 433 | 1.78 | 16.65 |
| Comparative Example 4 | — | 434 | 1.58 | 1.68 |
| Comparative Example 5 | — | 434 | 1.92 | 15.41 |
| Comparative Example 6 | — | 428 | 1.25 | 9.15 |
| Comparative Example 7 | — | 428 | 1.58 | 5.18 |
| Comparative Example 8 | — | 430 | 1.65 | 12.55 |
| Comparative Example 9 | — | 430 | 1.33 | 12.89 |
| Comparative Example 10 | — | 432 | 1.90 | 8.64 |
| Comparative Example 11 | — | 432 | 2.02 | 7.67 |
| Comparative Example 12 | — | 421 | 1.19 | 1.82 |
| Comparative Example 13 | — | 426 | 1.45 | 3.85 |

*Measured in acetone

EXAMPLE 11

A transfer recording sheet was prepared and transfer recording was conducted in the same manner as in Example 1 except that an ink prepared according to the following formulation was used in place of the ink used in Example 1. As a result, a recorded image which was of a vivid yellow color and had a uniform color density could be obtained. Further, the recorded image was subjected to a light resistance test and the transfer recording sheet and recorded image were subjected to a storage stability test in the dark. As-a result, good results were obtained in each test.

| Preparation of Ink | |
|---|---|
| Same dyestuff as that in Example 1 (dyestuff No. 3 in Table 1) | 5 g |
| AS resin** | 10 g |
| Toluene | 90 g |
| Cyclohexanone | 10 g |
| Total | 115 g |

**AS resin: trade name, "Denka AS-S"; manufactured by Denki Kagaku Kogyo K.K., Japan; Vicat softening point (JIS K-6870) 105° C.

While the invention has been described in detail and with reference to specific embodiments thereof, it will be apparent to one skilled in the art that various changes and modifications can be made therein without departing from the spirit and scope thereof.

What is claimed is:

1. A thermal transfer recording sheet comprising a substrate having thereon a colorant layer, said colorant layer comprising a binder and a pyridone-type azo dyestuff represented by the following general formula (I):

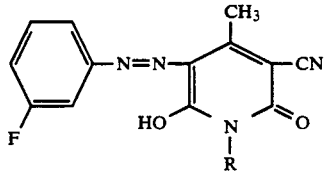

(I)

wherein R represents a hydrogen atom, an alkyl group having 2 or more carbon atoms, a substituted alkyl group selected from the group consisting of hydroxy-substituted alkyl groups, carboxy-substituted alkyl groups, cyano-substituted alkyl groups, amino-substituted alkyl groups, halogen-substituted alkyl groups, alkyl groups substituted with phenyl group which may have a halogen atom, alkoxyalkoxy-substituted alkyl groups, alkenyloxy-substituted alkyl groups, aryloxy-substituted alkyl groups, aralkyloxy-substituted alkyl groups, alkyl groups substituted with an acyloxy group which may have a halogen atom, alkyl groups substituted with a substituted or unsubstituted alkoxycarbonyl group, alkyl groups substituted with a substituted or unsubstituted alkoxycarbonyloxy group and heterocyclic ring-substituted alkyl groups, a cycloalkyl group, allyl group, or a substituted or unsubstituted phenyl group.

2. A sheet as claimed in claim 1, wherein R in general formula (I) represents a hydrogen atom; a straight-chain or branched alkyl group having 2 to 8 carbon atoms; a substituted alkyl group which is derived from a straight-chain or branched alkyl group having 1 to 8 carbon atoms and has a substituent selected from the group consisting of hydroxyl group, carboxyl group, cyano group, amino group, a halogen atom, phenyl group which may have a halogen atom, an alkoxy-alkoxy group, an alkenyloxy group, an aryloxy group, an aralkyloxy group, an acyloxy group which may have a halogen atom, a substituted or unsubstituted alkoxycarbonyl group, a substituted or unsubstituted alkoxycarbonyloxy group, and a heterocyclic group; cyclohexyl or cyclopentyl group; allyl group; phenyl group; or phenyl group substituted with a substituent selected from the group consisting of a straight-chain or branched alkyl group having 1 to 8 carbon atoms, a straight-chain or branched alkoxyl group having 1 to 4 carbon atoms, a halogen atom, nitro group, cyano group, and trifluoromethyl group.

3. A sheet as claimed in claim 1, wherein R in general formula (I) represents a group selected from the group consisting of a straight-chain or branched alkyl group having 2 to 8 carbon atoms, benzyl group, 2-phenylethyl group, allyl group, and a dialkylaminoalkyl group having 4 to 10 carbon atoms.

4. A sheet as claimed in claim 1, wherein said binder is a water-soluble resin selected from the group consisting of cellulose resins, acrylic acid-based resins, polyvinyl alcohols, polyethylene oxides, and starches, or an organic solvent-soluble resin selected from the group consisting of acrylic resins, methacrylic resins, polystyrenes, polycarbonates, polysulfones, AS resins, polyethersulfones, epoxy resins, polyvinyl acetals, phenoxy resins, polyvinyl butyrals, polyesters, ethyl celluloses, and acetyl celluloses.

5. A sheet as claimed in claim 1, wherein said substrate is a sheet of paper selected from capacitor paper and glassine paper or a film of heat-resistant plastics selected from the group consisting of polyesters, polycarbonates, polyamides, polyimides, and polyaramids, and has a thickness in the range of from 1 to 50 μm.

6. A sheet as claimed in claim 5, wherein said substrate is a polyethylene terephthalate film.

7. A sheet as claimed in claim 5, wherein said substrate has a heat-resistant resin layer on the side thereof opposite to the colorant layer.

8. A sheet as claimed in claim 1, wherein R in general formula (I) represents 2-ethylhexyl group.

* * * * *